US006415928B1

(12) United States Patent
Giacci

(10) Patent No.: US 6,415,928 B1
(45) Date of Patent: Jul. 9, 2002

(54) DISPLAY CONTAINER

(75) Inventor: William J. Giacci, Sylvania, OH (US)

(73) Assignee: Classic Metal Works, Inc., Sylvania, OH (US)

( * ) Notice: Subject to any disclaimer, the term of this patent is extended or adjusted under 35 U.S.C. 154(b) by 0 days.

(21) Appl. No.: 09/890,014

(22) PCT Filed: Jan. 5, 2001

(86) PCT No.: PCT/US01/00391

§ 371 (c)(1),
(2), (4) Date: Jul. 25, 2001

(87) PCT Pub. No.: WO01/49582

PCT Pub. Date: Jul. 12, 2001

Related U.S. Application Data

(60) Provisional application No. 60/174,461, filed on Jan. 5, 2000.

(51) Int. Cl.[7] ..... B65D 25/54

(52) U.S. Cl. ..... 206/781; 206/335

(58) Field of Search ..... 206/335, 561, 206/564, 776, 781, 782, 457; 108/26, 187; 312/300, 325

(56) References Cited

U.S. PATENT DOCUMENTS

| | | | | | |
|---|---|---|---|---|---|
| 376,261 | A | | 1/1888 | Rosenthal | |
| 1,699,025 | A | * | 1/1929 | Schulz | 206/561 |
| D83,608 | S | | 3/1931 | Gross | |
| 2,275,293 | A | | 3/1942 | Foley | |
| 2,498,757 | A | | 2/1950 | High | |
| 2,701,089 | A | | 2/1955 | Fischer | |
| 3,429,427 | A | * | 2/1969 | Wolf | 206/561 |
| 3,533,503 | A | * | 10/1970 | Wood | 206/776 |
| 3,935,944 | A | | 2/1976 | Wilson ET AL. | |
| 4,293,074 | A | * | 10/1981 | Dunsky | 206/564 |
| 4,739,353 | A | | 4/1988 | Heuer et al. | |
| 4,860,947 | A | | 8/1989 | Wauters | |
| 5,263,588 | A | * | 11/1993 | Bryde | 206/564 |
| 5,758,777 | A | | 6/1998 | Dods | |
| 5,908,112 | A | | 6/1999 | Hardie | |
| 5,980,352 | A | * | 11/1999 | Rigberg | 206/776 |
| 6,152,298 | A | * | 11/2000 | Dods | 206/335 |
| 6,170,659 | B1 | * | 1/2001 | Hunter | 206/335 |

* cited by examiner

*Primary Examiner*—Luan K. Bui
(74) *Attorney, Agent, or Firm*—Donald R. Fraser

(57) ABSTRACT

A display container comprises a base having a planar supporting surface, the planar supporting surface being cant relative to horizontal along two orthogonal axes. The display container may also include a transparent cover disposed on the base, and a box foldingly enclosing the base and the transparent cover.

9 Claims, 3 Drawing Sheets

DISPLAY CONTAINER

This application claims the benefit of U.S. Provisional Patent Application Ser. No. 60/174,461, filed Jan. 5, 2000.

FIELD OF THE INVENTION

The present invention relates generally to a display container, and more particularly to a display container for displaying a model vehicle or action figure, where the surface of the base of the display container is angularly disposed.

BACKGROUND OF THE INVENTION

Display containers are useful for displaying any number of items. Display containers help to protect valuable items by preventing dirt, dust, or other contaminants from contacting and building up on the item being displayed. Some display containers have a decorative design to aesthetically enhance the item being displayed.

Model vehicles, such as cars, trucks, tractors, locomotives, and the like, action figures, coins, and other items are often displayed in a display container having a base with a level display surface. This level display surface permits a viewer to see only the side view of the item facing the viewer. Visual enjoyment of the item is thus hindered unless the display case is picked up or the item is removed from the display container. Damage may result from the additional handling of the item, and is therefore undesirable to a collector.

It would be desirable to produce a display container wherein the visual enjoyment of the item being displayed would be enhanced, and a maximized perspective of the displayed item would be presented to the viewer.

SUMMARY OF THE INVENTION

An improved display container, wherein the displayed item is enhanced and presented to the viewer in a maximized perspective, has surprisingly been discovered. The display container comprises a base having a planar supporting surface, said planar supporting surface being cant relative to horizontal along two orthogonal axes.

The inventive display container is particularly well-suited for displaying model vehicles, such as automobiles, trucks, tractors, locomotives, and the like, action figures, coins, and many other items (hereinafter collectively referred to as "models" ).

BRIEF DESCRIPTION OF THE DRAWINGS

The above, as well as other features and advantages of the present invention, will best be understood from the detailed description of the preferred embodiment of the present invention, with reference to the accompanying drawings, in which.

DETAILS DESCRIPTION OF THE PREFERRED EMBODIMENT

The display container according to the present invention comprises a base having a planar supporting surface, the planar supporting surface being cant relative to horizontal along two orthogonal axes. The display container may also comprise a transparent cover disposed on the base, and a box foldingly enclosing the base and the transparent cover.

Figure 1:
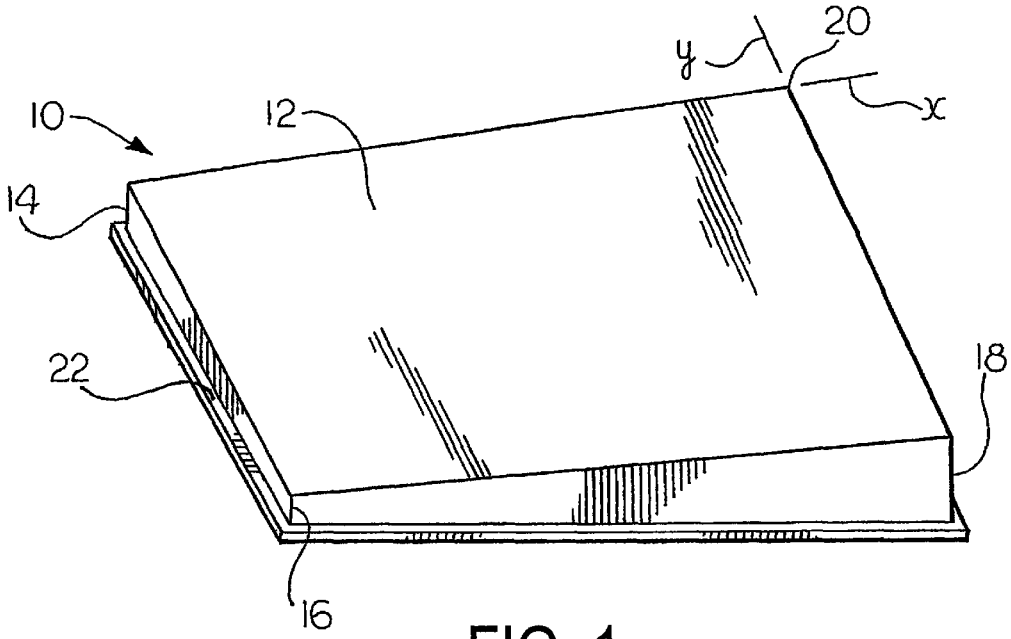
FIG. 1 is a perspective view of the base of a display container incorporating the features of the present invention, wherein the base is shown with a cant display surface.

Referring now to the Drawings, and particularly FIG. 1, there is shown generally at 10 a base of a display container for displaying a model. The supporting surface 12 of the base 10 is inclined from horizontal along two orthogonal axes x and y, to result in a cant supporting surface 12. At least three of the four corners 14, 16, 18, and 20 have different lengths in order to form the cant supporting surface 12. A lip 22 is formed along the bottom perimeter of the side walls of the base 10.

Figure 2:
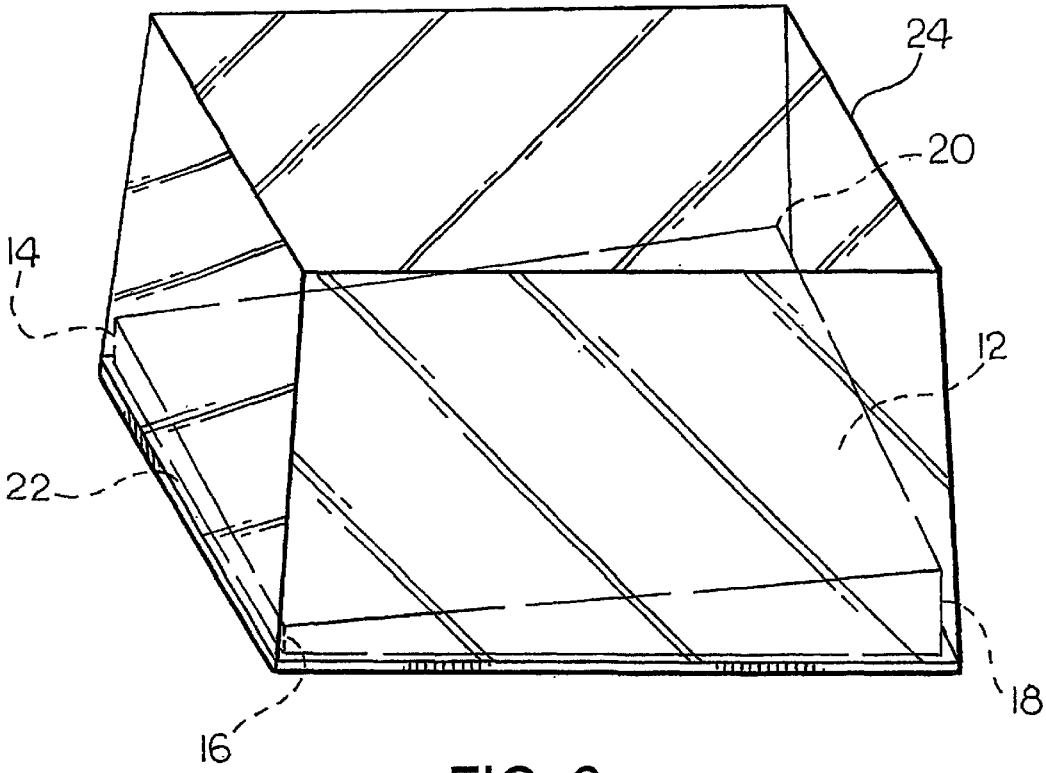
FIG. 2 is a perspective view of the base of the display container illustrated in FIG. 1, showing the base including a transparent cover.

A transparent plastic cover 24 may be disposed on the lip 22 of the base 10, as illustrated in FIG. 2. The transparent cover 24 is formed of five substantially rectangular surfaces in the general shape of a box. Alternatively, the four sidewalls of the box may be generally trapezoidal to form an angled transparent cover. The open side of the cover 24 permits the cover to be placed over the base 10 onto the lip 22.

Figure 3:
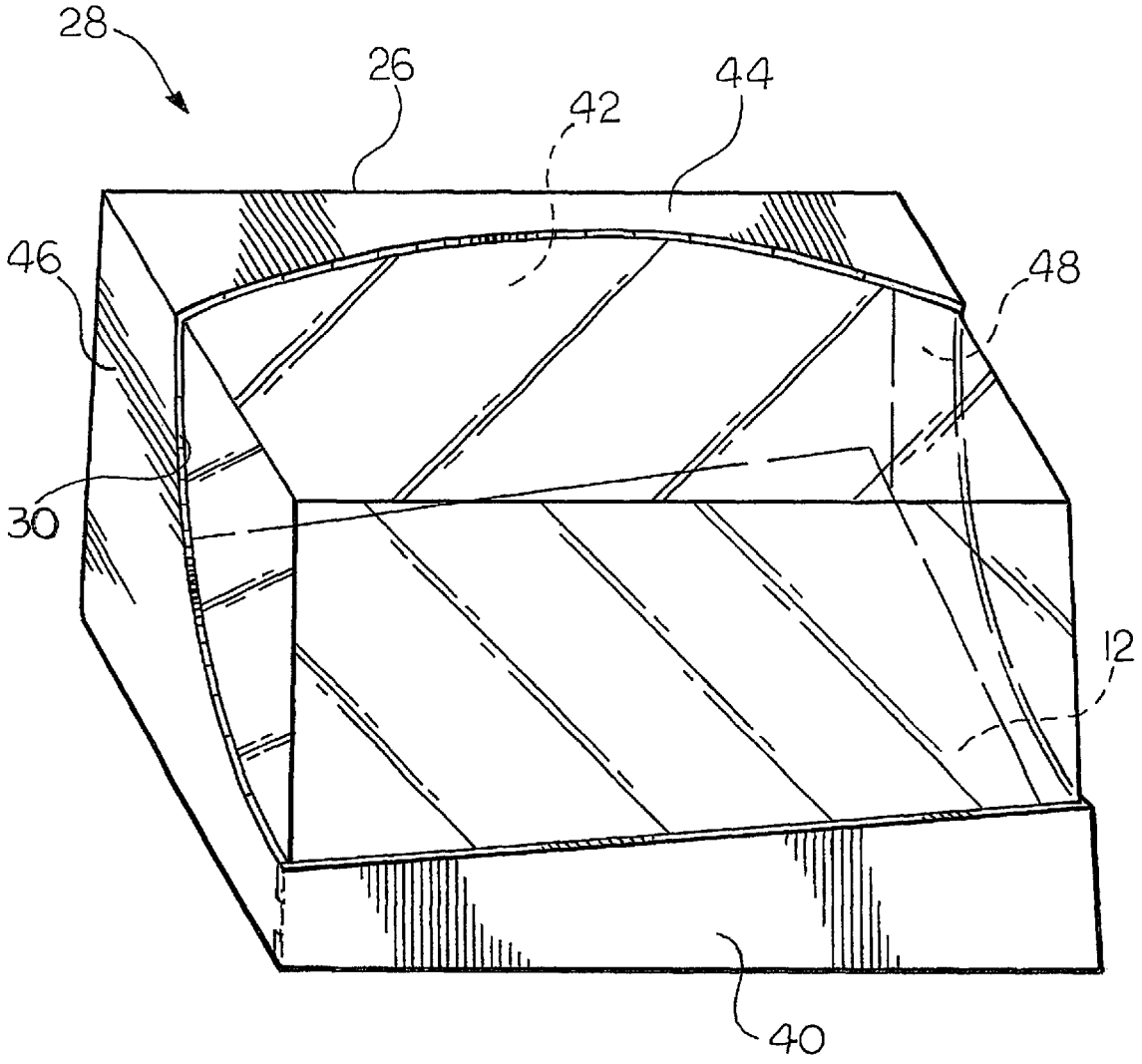
FIG. 3 is a perspective view of the display container illustrated in FIG. 2, including a box folded to form an outer package around the base and transparent cover combination illustrated in FIG. 2.
Figure 4:
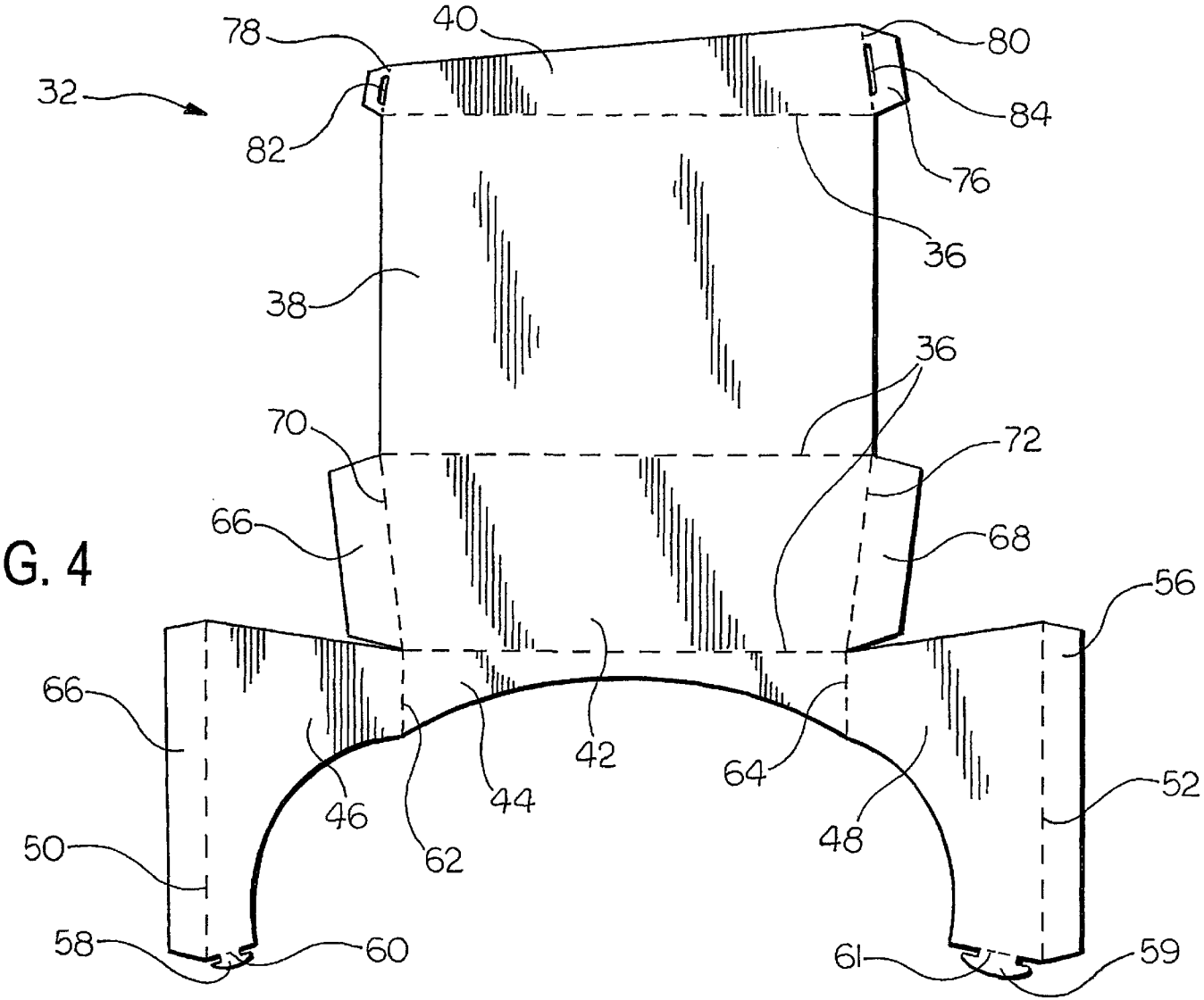
FIG. 4 is a planar view showing a flat blank from which it is possible to form the box illustrated in FIG. 3.

Referring now to FIGS. 3 and 4, there is shown a box 26 that may cooperate with the base 10 and the cover 24 to form the display container, shown generally at 28. The box 26 has a cutout section 30 formed therein. The shape of the cutout section 30 permits viewing of the contents of the display container 28 from four directions. The box 26 also permits the display of printed information and the like about the contents of the display container 28.

The box 26 may be formed from a flat cutout blank, shown generally at 32 in FIG. 4. The blank 32 includes a generally rectangular central portion provided with spaced apart parallel score lines 36. The score lines 36 divide the rectangular central portion into a bottom 38, a front 40, a back 42 and a top 44. Two top flap portions 46 and 48 extend from opposite ends of the top 44. Score lines 50 and 52 are formed on the top flap portions 46 and 48 to define side flap portions 54 and 56, respectively. Tabs 58 and 59 are formed to extend from top flap portions 46 and 48, respectively. Score lines 60 and 61 are formed to enable the tabs 58 and 59 to be folded with respect to the top flap portions 46 and 48, respectively. Score lines 62 and 64 are formed to enable the side flap portions 54 and 56, respectively, to move relative to the top 44. Back flap portions 66 and 68 extend from opposite ends of the back 42. Score lines 70 and 72 are formed to enable the back flap portions 66 and 68, respectively, to be flexed relative to the back 42. Front flap portions 74 and 76 extend from opposite ends of the front 40 and are provided with score lines 78 and 80, respectively, to facilitate the movement or flexure of the front flap portions 74 and 76 relative to the front 40. Slots 82 and 84 are formed at the middle portion of the score lines 78 and 80, respectively.

In forming the box 26, the back flap portions 66 and 68 are folded along the score lines 70 and 72 until the back flap portions 66 and 68, respectively, are substantially perpendicular to the back 42. The rectangular central portion is then folded along the score line 36 until the top 44 and the back 42, the back 42 and the bottom 38, and the bottom 38 and the front 40 are substantially perpendicular to each other. The front flap portions 74 and 76 are next folded along the score lines 78 and 80 until the front flap portions 74 and 76, respectively, are substantially perpendicular to the front 40. The side flap portions 54 and 56 are folded along score lines 50 and 52 until the side flap portions 54 and 56 are substantially perpendicular to top flap portions 46 and 48, respectively. The top flap portions 46 and 48 are then folded along score lines 62 and 64 until the top flap portions 46 and 48, respectively, are substantially perpendicular to the top 42. The side flap portions 54 and 56 are inserted in a space formed between the back flap portions 66 and 68, respectively, and the bottom 38. The tabs 58 and 59 are then folded along the score lines 60 and 61 and inserted into the tabs 82 and 84, respectively.

Due to the design of the base 10, cover 24, and box 26, the display container 28 provides for enhanced viewing of the model being displayed. The cant orientation of the supporting surface 12, in combination with the shape of the cutout section 30, permits the viewer to view the top and the sides of the model on display. The aesthetic and sales value of the model being displayed is thereby greatly enhanced.

The base and cover according to the present invention may be made of any material conventionally used for producing display containers. Preferred materials include metals, wood, ceramics, and plastics for the base, and ceramics (glasses) and plastics for the cover. It is particularly preferred to prepare the base and cover from plastics including, but not necessarily limited to, polycarbonates, polyesters, polymethyl methacrylates, acrylics, styrenics, polyurethanes, polyamides, and the like, as well as copolymers, derivatives, and blends thereof.

The box according to the present invention may be prepared from any conventional material currently used to manufacture containers. Examples include, but are not necessarily limited to, paper, cardboard, plastic films, metal foils, and the like, as well as laminates and combinations thereof.

From the foregoing description, one ordinarily skilled in the art can easily ascertain the essential characteristics of this invention and, without departing from the spirit and scope thereof, can make various changes and modifications to the invention to adapt it to various usages and conditions. For example, although the display container is illustrated as having four sides, the invention also contemplates display containers having three, five, or a greater number of sides.

What is claimed is:

1. A display container, comprising:

a base having a planar supporting surface, said planar supporting surface being cant relative to horizontal along two orthogonal axes;

a transparent cover disposed on said base; and a box, said box foldingly enclosing said base and said transparent cover.

2. The display container according to claim 1, wherein the base further comprises base sidewalls projecting downwardly from the perimeter of the planar supporting surface.

3. The display container according to claim 2, wherein the base further comprises a lip formed at the lower terminus of each of the base sidewalls.

4. The display container according to claim 1, wherein the degree of cant along each of the two orthogonal axes is different.

5. The display container according to claim 1, wherein the transparent cover further comprises a plurality of interconnected sidewalls, each of said sidewalls connected at its upper terminus to a generally horizontal top, and each of said sidewalls having a generally rectangular configuration.

6. The display container according to claim 5, wherein each of the sidewalls has a generally trapezoidal configuration.

7. The display container according to claim 1, wherein the box includes a cutout section which permits viewing of an exposed portion of the transparent cover.

8. A display container, comprising:

a base having a planar supporting surface, said planar supporting surface being cant relative to horizontal along two orthogonal axes, said base including base sidewalls projecting downwardly from the perimeter of said planar supporting surface, said base including a lip formed at the lower terminus of each of said base sidewalls, wherein the degree of cant along each of the two orthogonal axes is different;

a transparent cover disposed on said base, said transparent cover including a plurality of interconnected sidewalls, each of said sidewalls connected at its upper terminus to a generally horizontal top, and each of said sidewalls having a generally rectangular configuration; and a box, said box foldingly enclosing said base and said transparent cover, said box including a cutout section which permits viewing of an exposed portion of said transparent cover.

9. The display container according to claim 8, wherein each of the sidewalls has a generally trapezoidal configuration.

* * * * *